US011116317B2

(12) United States Patent
LeBlanc

(10) Patent No.: US 11,116,317 B2
(45) Date of Patent: Sep. 14, 2021

(54) FLOATING SHELF BRACKETS AND METHODS OF USING SAME

(71) Applicant: Lewis Hyman, Inc., Carson, CA (US)

(72) Inventor: Robert LeBlanc, Kennesaw, GA (US)

(73) Assignee: Lewis Hyman, Inc., Carson, CA (US)

( * ) Notice: Subject to any disclaimer, the term of this patent is extended or adjusted under 35 U.S.C. 154(b) by 0 days.

(21) Appl. No.: 16/677,206

(22) Filed: Nov. 7, 2019

(65) Prior Publication Data

US 2020/0146450 A1 May 14, 2020

Related U.S. Application Data

(60) Provisional application No. 62/757,312, filed on Nov. 8, 2018.

(51) Int. Cl.

| | |
|---|---|
| ***A47B 96/00*** | (2006.01) |
| ***A47B 96/06*** | (2006.01) |
| ***A47B 96/02*** | (2006.01) |

(52) U.S. Cl.

CPC ..... *A47B 96/067* (2013.01); *A47B 96/027* (2013.01)

(58) Field of Classification Search

CPC ... A47B 96/067; A47B 96/027; A47B 96/066; A47B 96/028; A47B 96/061; A47B 96/021; A47B 96/022; A47B 96/062

USPC ..... 108/106–108, 157.13, 147.17; 248/235; 211/90.01

See application file for complete search history.

(56) References Cited

U.S. PATENT DOCUMENTS

| | | | | | |
|---|---|---|---|---|---|
| 830,943 | A * | 9/1906 | Wessels | | |
| 1,599,653 | A * | 9/1926 | Cranston | A47B 96/028 | 108/185 |
| 3,143,980 | A * | 8/1964 | Sperring | A47B 96/066 | 108/108 |
| 3,284,040 | A * | 11/1966 | Marontate | A47B 96/027 | 248/235 |
| 5,316,253 | A * | 5/1994 | Flathau | E04G 5/062 | 248/235 |
| 6,098,566 | A * | 8/2000 | Metcalf | B63B 29/00 | 114/362 |
| 6,164,610 | A * | 12/2000 | Santiago | A47B 96/022 | 211/90.01 |
| 9,594,933 | B2 * | 3/2017 | Kuniavsky | G06K 19/0776 | |
| 9,861,198 | B2 * | 1/2018 | Anderson | A47B 96/028 | |
| 10,575,641 | B1 * | 3/2020 | Severa | A47B 96/021 | |

(Continued)

FOREIGN PATENT DOCUMENTS

| | | | |
|---|---|---|---|
| EP | 3005904 | * | 4/2016 |
| GB | 2214414 | * | 9/1989 |

OTHER PUBLICATIONS

Amazon.com Homewell Wood Floating shelves for Home Decoration, grey ; eariliest review Jan. 30, 2018 (Year: 2018).*

*Primary Examiner* — Janet M Wilkens
(74) *Attorney, Agent, or Firm* — Brient IP Law, LLC

(57) ABSTRACT

A floating shelf includes a plank shelf, and a floating shelf bracket, configured to support the plank shelf, including a connecting bar and two or more bracket arms attached to one another by the connecting bar. The connecting bar and the two or more bracket arms may be permanently attached to one another so that the floating shelf bracket is a unitary, single-piece bracket. The connecting bar and the two or more bracket arms may be removably attached to one another.

14 Claims, 6 Drawing Sheets

(56) References Cited

U.S. PATENT DOCUMENTS

2009/0224119 A1* 9/2009 Heffernan ..... A47B 96/066
248/225.11

* cited by examiner

FLOATING SHELF BRACKETS AND METHODS OF USING SAME

CROSS-REFERENCE TO RELATED APPLICATION

This application claims the benefit of priority to U.S. Provisional Patent Application No. 62/757,312, filed Nov. 8, 2018, which is hereby incorporated by reference in its entirety for all purposes.

BACKGROUND

1. Field

The following description relates to floating shelf brackets for holding up floating shelves. In addition, a method of using floating shelf brackets is also described.

2. Description of Related Art

Current bracket shelves installation methods require a consumer to hang at least two brackets separately. It is difficult to level the brackets in a proper position and have a plank shelf lay straight. Typically, each bracket is hung separately so that a first bracket is hung and leveled first, and a level is used to ensure that the second bracket is hung at a position which is aligned with the first bracket.

Conventional brackets used for floating shelves are typically provided as more than one piece which may not be combined with one another. The shelf must be leveled using the shelf brackets. As a result, the hanging process is a multiple step process which can be timely and complicated, and may require professional assistance.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one aspect, a floating shelf includes a plank shelf, and a floating shelf bracket, configured to support the plank shelf, including a connecting bar and two or more bracket arms attached to one another by the connecting bar, where the connecting bar and the two or more bracket arms are permanently attached to one another so that the floating shelf bracket is a unitary, single-piece bracket.

The floating shelf may include an elongated opening formed on a rear side of the floating shelf which is configured to come into contact with the connecting bar at a supported position.

The connecting bar and the two or more bracket arms may each include a plurality of screw holes which are countersunk to ensure that heads of corresponding screws received by the plurality of screw holes are flush with surfaces of the connecting bar and the two or more bracket arms.

The plank shelf may be at least one of about 24 inches wide, about 36 inches wide, and about 42 inches wide, and the floating shelf bracket may be at least one of about 21.5 inches wide, about 30.7 inches wide, and about 35 inches wide.

The floating shelf bracket may further include an intermediate connecting bar.

The two or more bracket arms may include at least three bracket arms which are evenly separated.

In another aspect, a floating shelf includes a plank shelf, and a floating shelf bracket, configured to support the plank shelf, including a connecting bar and two or more bracket arms attached to one another by the connecting bar, where the connecting bar and the two or more bracket arms are removably attached to one another.

The floating shelf may include an elongated opening formed on a rear side of the floating shelf which is configured to come into contact with the connecting bar at a supported position.

The connecting bar and the two or more bracket arms may each include a plurality of screw holes which are countersunk to ensure that heads of corresponding screws received by the plurality of screw holes are flush with surfaces of the connecting bar and the two or more bracket arms.

The plank shelf may be at least one of about 24 inches wide, about 36 inches wide, and about 42 inches wide, and the floating shelf bracket may be at least one of about 21.5 inches wide, about 30.7 inches wide, and about 35 inches wide.

The floating shelf bracket may further include an intermediate connecting bar.

The connecting bar may include a pair of projections and each of the two or more bracket arms may include an opening for receiving one of the pair of projections.

The projection may become gradually wider as it projects father from the connecting bar.

The projection may include a slot opening at an upper side of the projection.

In another aspect, a method of using a floating shelf includes providing a floating shelf which includes a plank shelf, and a floating shelf bracket, configured to support the plank shelf, including a connecting bar and two or more bracket arms attached to one another by the connecting bar, leveling and hanging the floating shelf bracket using the connecting bar, and placing the plan shelf on top of the floating shelf bracket.

The method may further include assembling the connecting bar and the two or more bracket arms of the floating shelf bracket prior to handing the floating shelf bracket.

BRIEF DESCRIPTION OF THE DRAWINGS

The foregoing summary, as well as the following detailed description, will be better understood when read in conjunction with the appended drawings. For the purpose of illustration, certain examples of the present description are shown in the drawings. It should be understood, however, that the invention is not limited to the precise arrangements and instrumentalities shown. The accompanying drawings, which are incorporated in and constitute a part of this specification, illustrate an implementation of system, apparatuses, and methods consistent with the present description and, together with the description, serve to explain advantages and principles consistent with the invention.

Figure 1:
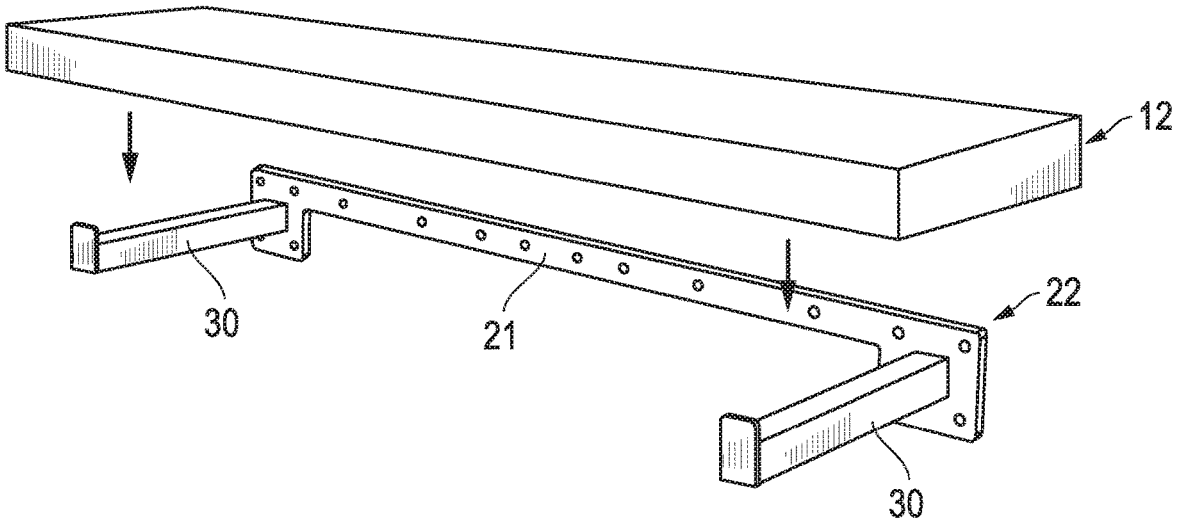
FIG. 1 is a diagram illustrating an example of a plank shelf with a floating shelf bracket.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity and are not intended to limit the scope of the invention or the appended claims. Further, it should be understood that any one of the features can be used separately or in combination with other features. Other systems, methods, features, and advantages of the invention will be or become apparent to one with skill in the art upon examination of the detailed description. It is intended that all such additional systems, methods, features, and advantages be included within this description, be within the scope of the present invention, and be protected by the accompanying claims.

Figure 2:
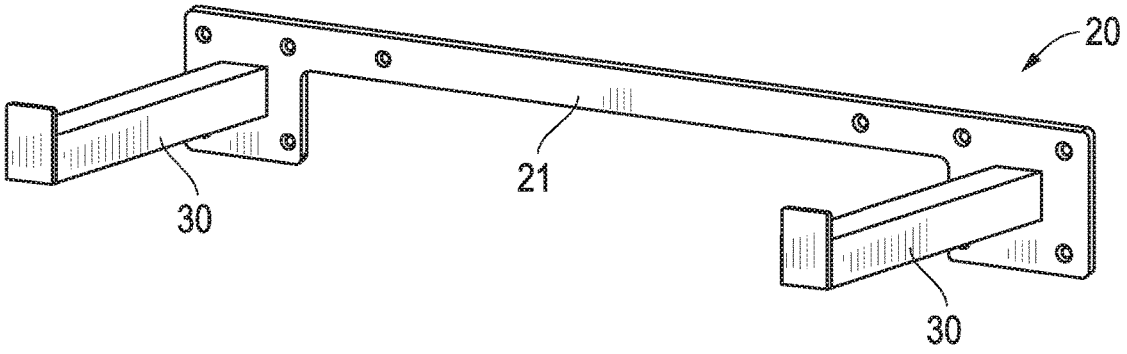
FIG. 2 is a diagram illustrating another example of a floating shelf bracket.

FIG. 1 is a diagram illustrating an example of a plank shelf 12 with a floating shelf bracket 22. FIG. 2 is a diagram illustrating another example of a floating shelf bracket 20.

Referring to FIGS. 1 and 2, the floating shelf bracket 20, 22 includes a connecting bar 21 that mounts directly on the wall and to which the bracket arms 30 may be permanently attached. In an example, the connecting bar 21 may include an optional small level attached for easy and quick leveling of the connecting bar 21. Leveling of the connecting bar 21 in turn levels the entire floating shelf bracket 22 so that the plank shelf 12 is also leveled once positioned on the floating shelf bracket 22. As a result, a quick two-step process of hanging the floating shelf may be achieved by first leveling and hanging the connecting bar 21 then placing the plank shelf 12 on the floating shelf bracket 22.

In this example, two bracket arms 30 are permanently attached to a connecting bar 21 so that together they form the floating shelf bracket 20, 22. However, the floating shelf brackets 20, 22 are not limited to including two bracket arms 30. In some examples, the floating shelf brackets 20, 22 include at least two bracket arms 30, at least three bracket arms 30, at least four bracket arms 30, at least five bracket arms 30, or any number of bracket arms 30.

Also, the floating shelf brackets 20, 22 may include permanently attached bracket arms 30 or removably attached bracket arms 30. Further, the floating shelf bracket 20, 22 may be of any width so that the floating shelf brackets 20, 22 may be longer or shorter to accommodate longer or shorter plank shelves 12. In the example of FIG. 1, the total width of the floating shelf bracket 22 from one end to another is about 30.7 inches to accommodate a shelf which is about 36 inches wide. In the example of FIG. 2, the total width of the floating shelf bracket 20 from one end to another is about 21.5 inches to accommodate a shelf which is about 24 inches wide. However, it should be appreciated that the floating shelf brackets 20, 22 may have any dimension of width, length, and thickness.

Figure 3:
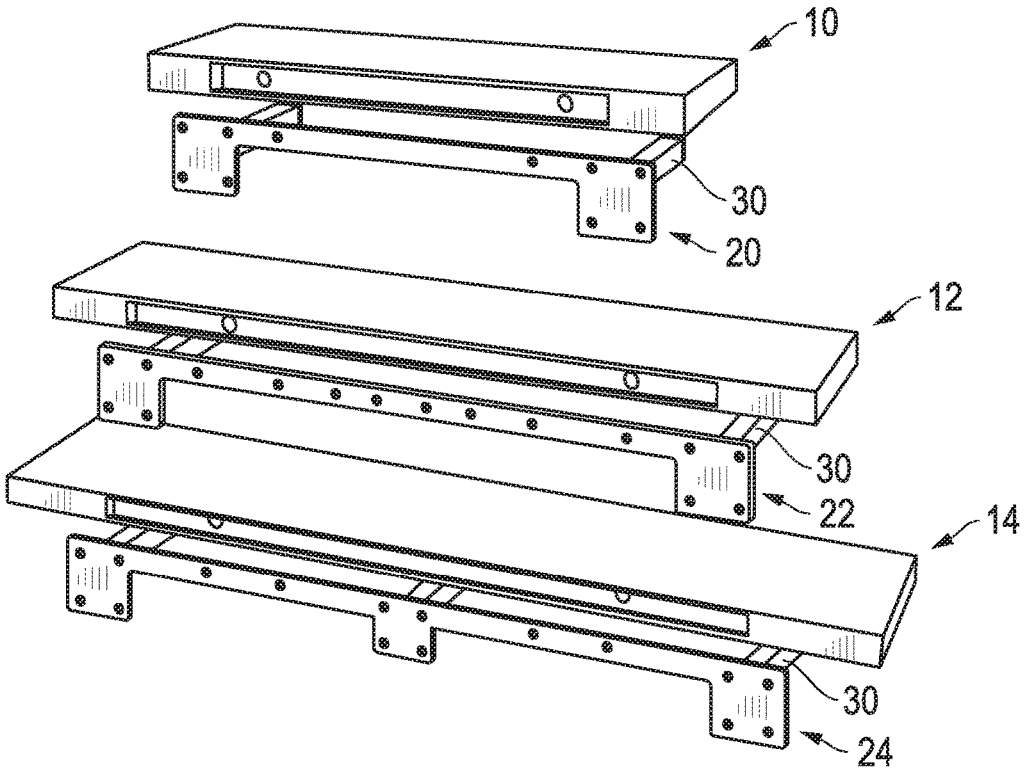
FIG. 3 is a diagram illustrating a rear view of the examples of the floating shelf bracket of FIGS. 1 and 2, and a further example of a floating shelf bracket each with a plank shelf.

FIG. 3 is a diagram illustrating a rear view of the examples of the floating shelf brackets 20, 22 of FIGS. 1 and 2, and a further example of a floating shelf bracket 24 each with a plank shelf 10, 12, 14.

Referring to FIG. 3, the back side of each of the plank shelves 10, 12, 14 may be set up like the standard, conventional floating bracket shelves which include holes formed on a rear side. Accordingly, the plank shelves 10, 12, 14 may be hung using a bracket which is inserted within the rear holes so that the bracket is completely unexposed and not visible from the outside once the shelf is hung. In this example, the plank shelves 10, 12, 14 are positioned on top of the floating shelf bracket 20, 22, 24. In the example of FIG. 3, the total width of the floating shelf bracket 24 from one end to another is about 35 inches to accommodate a shelf which is about 42 inches wide. However, it should be appreciated that the floating shelf brackets 20, 22, 24 may have any dimension of width, length, and thickness.

Figure 4:
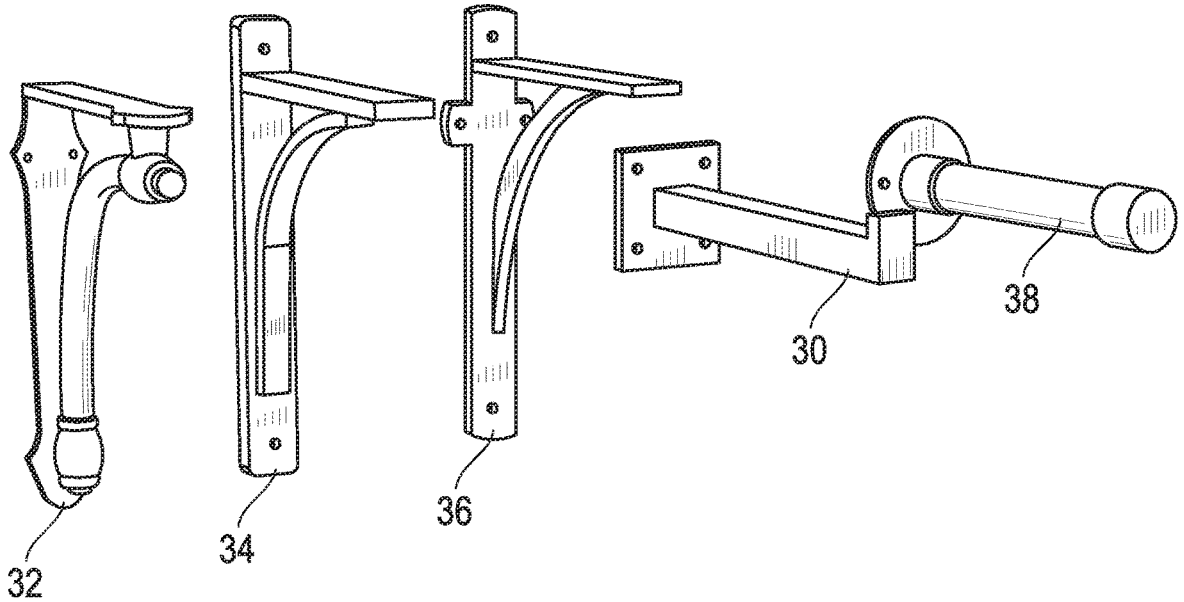
FIG. 4 is a diagram illustrating five examples of floating shelf bracket arms.

FIG. 4 is a diagram illustrating five examples of floating shelf bracket arms 30, 32, 34, 36, 38.

Referring to FIG. 4, the floating shelf bracket arms 30, 32, 34, 36, 38 may each be permanently attached to a connecting bar 21 to form a floating shelf bracket, similar to the examples described in FIGS. 1-3. That is, instead of the square end bracket arm 30 shown in FIGS. 1-3, any of these brackets 32, 34, 36, 38 or any other brackets. The floating shelf bracket arms 30, 32, 34, 36, 38 include a square end bracket arm 30, a circular bracket arm 38, a decorative flat shelf bracket arm 32, and different examples of simple flat shelf bracket arms 34, 36. Any number and combination of bracket arms 30, 32, 34, 36, 38. In the preferred example, at least two bracket arms 30, 32, 34, 36, 38 are permanently attached, one at each end of the connecting bar 21.

Figure 5:
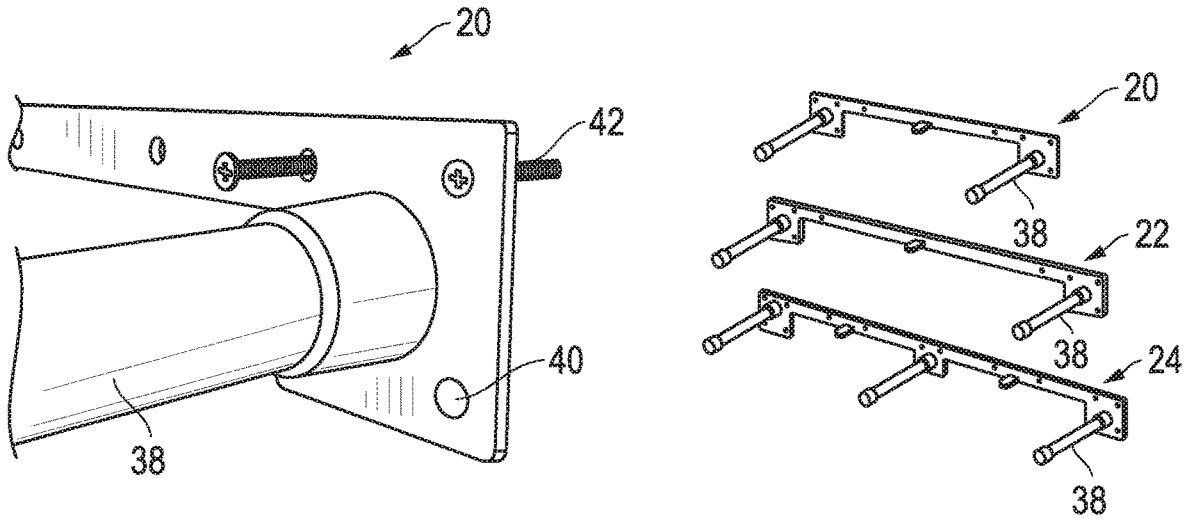
FIG. 5 is a diagram illustrating other examples of floating shelf brackets with one of the floating shelf bracket arms of FIG. 4.

FIG. 5 is a diagram illustrating other examples of floating shelf brackets 20, 22, 24 with one of the floating shelf bracket arms 38 of FIG. 4.

Referring to FIG. 5, the floating shelf bracket 20 may include two circular bracket arms 38 and may have a width from one end to another that is about 21.5 inches to accommodate a shelf that is about 24 inches wide. The floating shelf bracket 22 may include two circular bracket arms 38 and may have a total width from one end to another that is about 30.7 inches to accommodate a shelf that is about 36 inches wide. The floating shelf bracket 24 may include three circular bracket arms 38 and may have a width from one end to another that is about 35 inches to accommodate a shelf that is about 42 inches wide. However, it should be appreciated that the floating shelf brackets 20, 22, 24 may have any dimension of width, length, and thickness.

In this example, the floating shelf brackets 20, 22 may have one set screw hole for receiving one set screw at a location in the center of the bracket 20, 22 as illustrated at the top of the figure. The floating shelf bracket 24 may have two set screw holes for receiving two set screws at different locations, centered in-between the left and center bracket arms 30 and in-between the center and right side bracket arms 20. All corresponding shelves may have rivets located on the bottom screw areas on each post bracket, concealing the screw holes. While only one or two set screw holes are illustrated, any number of set screw holes may be used. The bracket set screw holes allow the shelf to be secured to the bracket using screws extending through the set screw holes. The bracket of FIG. 5 with the set screw holes may be used with any of the examples, bracket arms, and sizes described throughout this application, and may be used instead of the brackets of FIGS. 1-3. Still referring to FIG. 5, in all examples throughout the application, countersunk screw holes 40 in the brackets 20, 22, 24 ensure that the corresponding shelf will sit flush on the bracket 20, 22, 24 and exposed screws 42 will not touch the back of the shelf paper. In a preferred example, bracket installation screw holes 40 are spaced about 16 inches apart in order to allow a consumer to align with a wall stud in residential stud standard placements.

Figure 6:
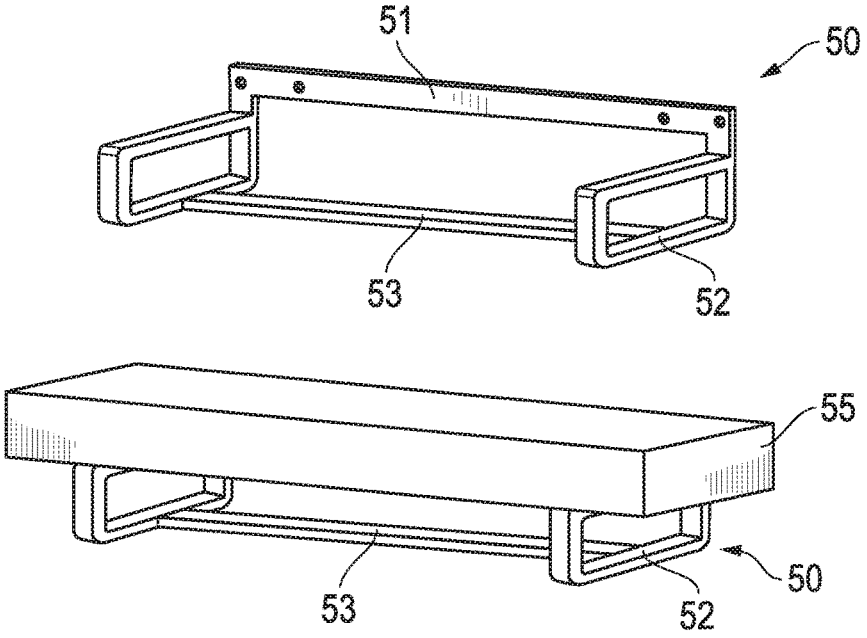
FIG. 6 is a diagram illustrating an example of a floating shelf bracket arm with an intermediate arm.

FIG. 6 is a diagram illustrating an example of a floating shelf bracket 52 arm with an intermediate arm 53.

Referring to FIG. 6, another example of a floating shelf bracket 50 with a plank shelf 55 is illustrated. In this example, the floating shelf bracket 50 is a one-piece, unitary bracket which includes a pair of bracket arms 52 at each end which are connected by a first connecting bar 51 and a second intermediate arm 53. As with other examples of floating shelf brackets 20, 22, 24, the floating shelf bracket 50 is easy to level and hang. As with the brackets 20, 22, 24 of FIG. 5, the bracket 50 of FIG. 6 may also include one or more set screw holes as described above.

FIGS. 7A, 7B, 7C, 7D, and 7E are diagrams illustrating an example of a connection between a connecting portion 72 of a removable bracket arm 34 and a connecting bar 21 of the floating shelf bracket.

Figure 7A:
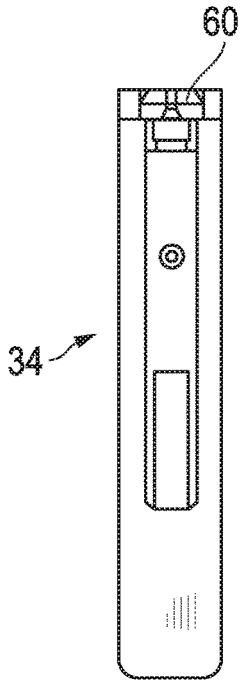
FIGS. 7A, 7B, 7C, 7D, and 7E are diagrams illustrating an example of a connection between a removable arm of a floating shelf bracket and a connecting bar of the floating shelf bracket.
Figure 7B:
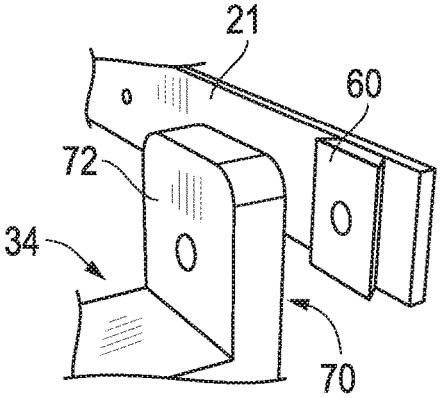
Figure 7C:
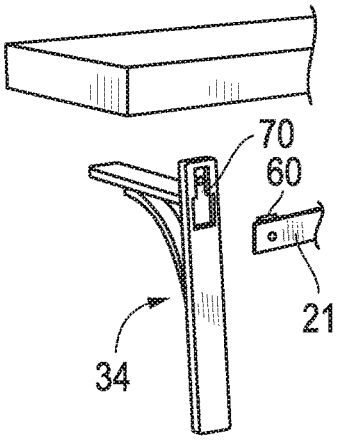
Figure 7D:
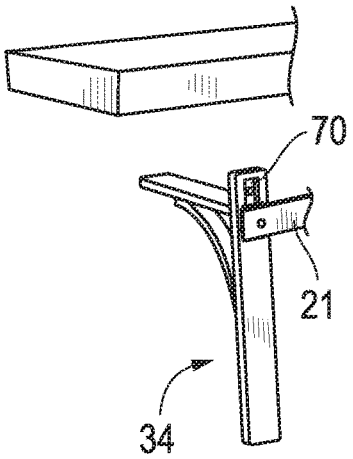
Figure 7E:
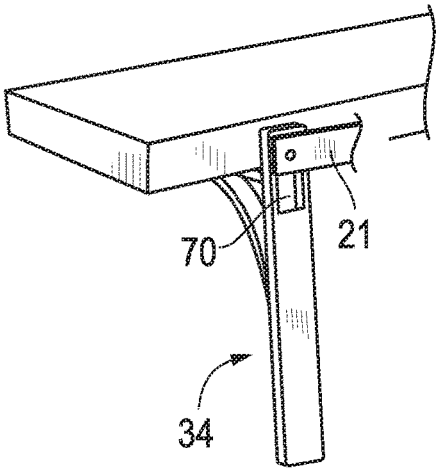

Referring to FIGS. 7A-7E, a first connection mechanism between a floating shelf bracket arm 34 and the connecting bar 21 is illustrated. The connecting bar 21 may include a projection 60 which is configured to be received and fitted into a corresponding shaped opening 70 in the bracket arm 34. The projection 60 may become gradually wider as it projects father from the connecting bar 21. The opening 70 of the removable bracket arm 34 may be narrower on its outer end at the top portion than at the bottom portion so that the outer end of the top portion acts as a barrier. That is, as shown in FIGS. 7D and 7E, the projection 60 may fit into the bottom portion of the opening 70 then, after sliding up the connecting bar 21, the outer edge of the top portion of the opening 70 acts as a barrier which is on top of the wider portion of the projection 60 to secure the connecting arm 21.

FIGS. 8A, 8B, 8C, 8D, and 8E are diagrams illustrating an example of another connection between a connection portion 72 of a removable bracket arm 34 and a connecting bar 21 of the floating shelf bracket.

Figure 8A:
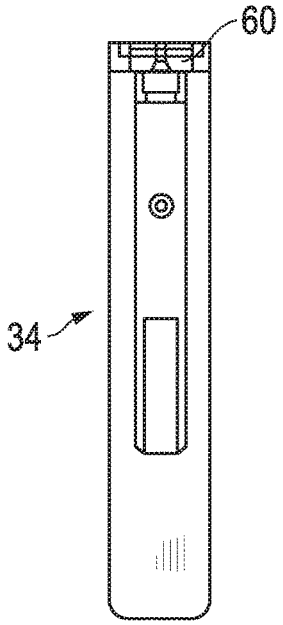
FIGS. 8A, 8B, 8C, 8D, and 8E are diagrams illustrating an example of a connection between a removable arm of a floating shelf bracket and a connecting bar of the floating shelf bracket.
Figure 8B:
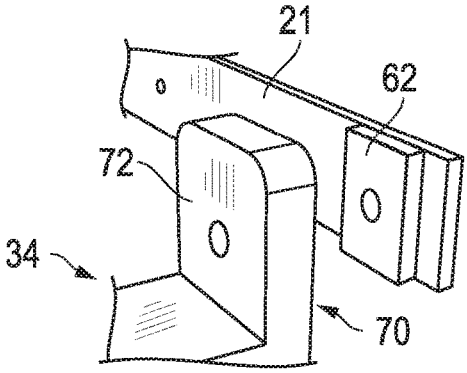
Figure 8C:
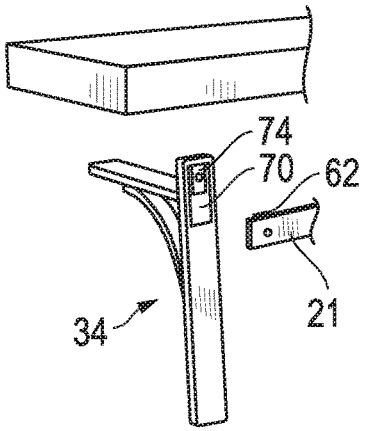
Figure 8D:
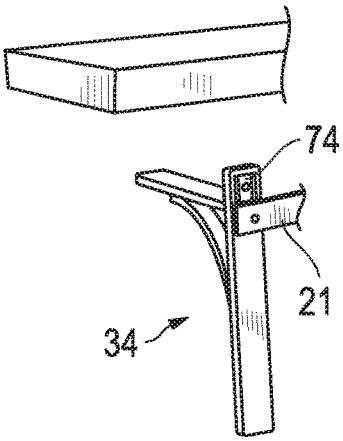
Figure 8E:
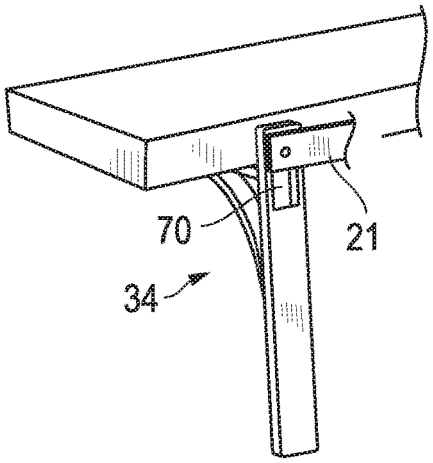

Referring to FIGS. 8A-8E, a second connection mechanism between a floating shelf bracket arm 34 and the connecting bar 21 is illustrated. The connecting bar 21 may include a projection 62 which is configured to be received and fitted into a corresponding shaped opening 70 in the bracket arm 34. The projection 62 may be a square-like or rectangular-like block which includes a slot on its upper side. The opening 70 of the removable bracket arm 34 may include another projection 74 that is received by the slot in the upper side of the opening 70. That is, as shown in FIGS. 8D and 8E, the projection 62 may fit into the bottom portion of the opening 70 then, after sliding up the connecting bar 21, the projection 74 may fit into the slot in the upper side of the opening 70 to secure the connecting arm 21.

Figure 9:
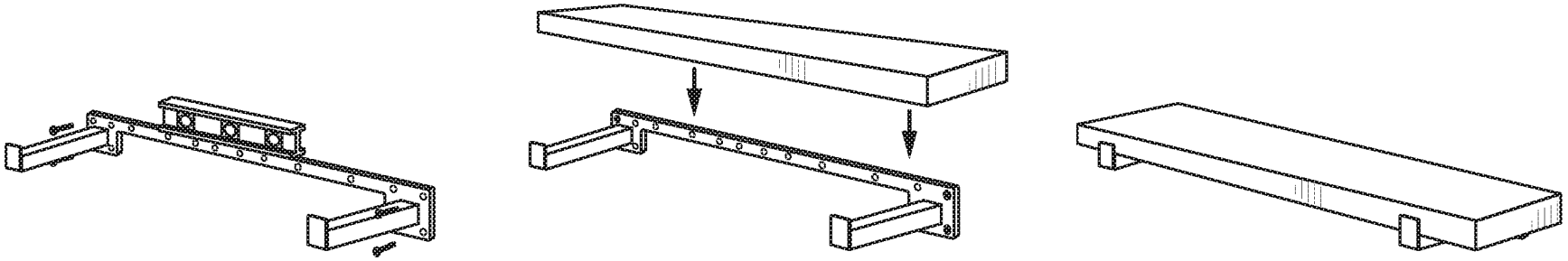
FIG. 9 is a diagram illustrating a multiple step process for hanging the floating shelves described throughout the application.

FIG. 9 is a diagram illustrating a multiple step process for hanging the floating shelves described throughout the application. In a first step, the floating shelf brackets 20, 22, 24 are hung and leveled. In a second step, the plank shelves 10, 12, 14 are positioned on top of the floating shelf brackets 20, 22, 24.

One of skill in the art will recognize that the described examples are not limited to any particular size. Further one of skill in the art will recognize that floating shelf brackets 20, 22, 24, 50, the connecting bars 21, 51, 53, the floating shelf bracket arms 30, 32, 34, 36, 38, and the plank shelves 10, 12, 14, 55 are not limited to any type of material. One skilled in the art will recognize that a number of designs, and types and thicknesses of materials can be utilized when taking into consideration aesthetic, safety, and stability consideration. A number of manufacturing techniques may be used.

It will be appreciated by those skilled in the art that changes could be made to the embodiments described above without departing from the broad inventive concept thereof. It is understood, therefore, that the invention disclosed herein is not limited to the particular embodiments disclosed, and is intended to cover modifications within the spirit and scope of the present invention.

What is claimed is:

1. A floating shelf, comprising:

a plank shelf; and a floating shelf bracket, configured to support the plank shelf, comprising a connecting bar and two or more bracket arms attached to one another by the connecting bar, wherein the connecting bar and the two or more bracket arms are permanently attached to one another so that the floating shelf bracket is a unitary, single-piece bracket, and wherein a top surface of each of the two or more bracket arms is positioned below a top of the connecting bar such that when a bottom surface of the plank shelf is positioned on the top surface of each of the two or more bracket arms, the top of the connecting bar is substantially concealed behind the plank shelf.

2. The floating shelf of claim 1, wherein the floating shelf comprises an elongated opening formed on a rear side of the floating shelf which is configured to come into contact with the connecting bar at a supported position.

3. The floating shelf of claim 1, wherein the connecting bar comprises a plurality of screw holes which are countersunk to ensure that heads of corresponding screws received by the plurality of screw holes are flush with a surface of the connecting bar.

4. The floating shelf of claim 1, wherein the plank shelf is at least one of about 24 inches wide, about 36 inches wide, and about 42 inches wide, and the floating shelf bracket is at least one of about 21.5 inches wide, about 30.7 inches wide, and about 35 inches wide.

5. The floating shelf of claim 1, wherein the floating shelf bracket further comprises an intermediate connecting bar.

6. The floating shelf of claim 1, wherein the two or more bracket arms comprise at least three bracket arms which are evenly separated.

7. A floating shelf, comprising:

a plank shelf; and a floating shelf bracket, configured to support the plank shelf, comprising a connecting bar and two or more bracket arms attached to one another by the connecting bar, wherein the connecting bar and the two or more bracket arms are removably attached to one another, wherein the connecting bar comprises a pair of projections and each of the two or more bracket arms comprises an opening for receiving one of the pair of projections, and wherein each projection becomes gradually wider as it projects farther from the connecting bar.

8. The floating shelf of claim 7, wherein the floating shelf comprises an elongated opening formed on a rear side of the floating shelf which is configured to come into contact with the connecting bar at a supported position.

9. The floating shelf of claim 7, wherein the connecting bar comprises a plurality of screw holes which are countersunk to ensure that heads of corresponding screws received by the plurality of screw holes are flush with a surface of the connecting bar.

10. The floating shelf of claim 7, wherein the plank shelf is at least one of about 24 inches wide, about 36 inches wide, and about 42 inches wide, and the floating shelf bracket is at least one of about 21.5 inches wide, about 30.7 inches wide, and about 35 inches wide.

11. The floating shelf of claim 7, wherein the floating shelf bracket further comprises an intermediate connecting bar.

12. The floating shelf of claim 7, wherein the projection comprises a slot opening at an upper side of the projection.

13. A method of using a floating shelf, comprising:

providing a floating shelf which comprises a plank shelf; and a floating shelf bracket, configured to support the plank shelf, comprising a connecting bar and two or more bracket arms attached to one another by the connecting bar, wherein a top surface of each of the two or more bracket arms is positioned below a top of the connecting bar such that when a bottom surface of the plank shelf is positioned on the top surface of each of the two or more bracket arms, the top of the connecting bar is substantially concealed behind the plank shelf;

leveling and hanging the floating shelf bracket using the connecting bar; and placing the plank shelf on top of the floating shelf bracket.

14. The method of claim 13, further comprising assembling the connecting bar and the two or more bracket arms of the floating shelf bracket prior to handing the floating shelf bracket.

* * * * *